United States Patent [19]

Keilhack

[11] Patent Number: 5,062,220

[45] Date of Patent: Nov. 5, 1991

[54] TEXTILE FABRIC DRYER AND METHOD

[76] Inventor: Hans O. Keilhack, P.O. Box 19042, Charlotte, N.C. 28219

[21] Appl. No.: 545,412

[22] Filed: Jun. 27, 1990

[51] Int. Cl.[5] ..... F26B 13/04

[52] U.S. Cl. ..... 34/155; 34/23; 34/25; 34/152; 34/154; 34/162

[58] Field of Search ..... 34/23, 207, 25, 208, 34/152, 153, 155, 154, 168, 162, 157; 198/434, 435

[56] References Cited

U.S. PATENT DOCUMENTS 3,359,648 12/1967 Overly et al. ..... 34/162 X
3,711,959 1/1973 van der Lely ..... 34/162 X
3,812,599 5/1974 Bruckner ..... 34/162 X
3,986,273 10/1976 Führing et al. ..... 34/155
4,506,456 3/1985 Lehtinen ..... 34/162 X
4,932,139 6/1990 Lehtinen ..... 34/152

FOREIGN PATENT DOCUMENTS 1423878 9/1988 U.S.S.R. ..... 34/152

*Primary Examiner*—Edward G. Favors
*Attorney, Agent, or Firm*—Bailey & Hardaway

[57] ABSTRACT

A textile fabric dryer and method of heat treating a shrinkable web in a range is illustrated wherein a plurality of serially arranged driven conveyor modules are provided for more accurately controlling tension in the web during heat treatment.

18 Claims, 3 Drawing Sheets

TEXTILE FABRIC DRYER AND METHOD

BACKGROUND OF THE INVENTION

This invention relates to fabric dryers utilizing an elongated oven with an improved conveyor system for controlling fabric shrinkage.

Fabric dryers constructed in accordance with the prior art are exemplified by the disclosure of U.S. Pat. No. 2,597,490, issued May 20, 1952 which is incorporated herein and made a part hereof by reference. Despite this and other efforts to solve the problem of garment shrinkage, such has persisted through the years. In order to prevent fabric shrinkage, the material must be shrunk as at the dryer wherein an attempt is made to restore the yarn or fibers of the fabric to a tensionless state and thereby remove the stretch previously imparted to the yarn or fibers and render the fabric less susceptible or at least partially immune to later shrinkage.

This objective has been met with only limited success with this and other prior art dryers or ranges occurs because of the extreme length of the conveyor necessary to transport the fabric through the oven and maintain the fabric in proper relation to the foraminous woven belt of the dryer while heated air is blown through the fabric. Due to the length of the endless conveyor, it is extremely difficult to control and to provide uniform tension to the fabric during its passage through the range. Because of the resulting lack of a uniform tensionless condition in the fabric during such transport, shrinkage is inhibited in a non uniform fashion causing uneven shrinkage characteristics to persist in the treated fabric.

Efforts to solve the problem have included the Continuous Drying Machine, Model P92/T, supplied by Essico of Milan, Italy. Such machines embody alternating blowing and sucking flows of heated air through the fabric along its path on the endless conveyor. Other prior art U.S. Patents of general interest include U.S. Pat. Nos. 518,332, 3,097,413 and 3,185,286.

Accordingly, it is an important object of this invention to provide a fabric dryer affording a more nearly uniform tensionless state to the fabric as it passes through the dryer.

Another important object is to provide shrink resistant fabric wherein any remaining tendency to shrink will be more nearly uniform.

An important object of the invention is the provision of a dryer and method wherein a number of conveyors are provided to maintain control over the tension in the fabric in such a way as to create a more nearly tensionless condition.

SUMMARY OF THE INVENTION

A modular textile fabric dryer has cascading pairs of conveyors having runs carrying fabric therebetween to control tension in the fabric when it is subjected to heated air.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a textile fabric drying and shrinking apparatus having an elongated oven containing means for blowing heated air upon fabric conveyed through the oven. A plurality of pairs of upwardly inclined conveyors are constructed of foraminous belts A and B each having opposed runs carrying the textile fabric therebetween. A drive C for each of the pairs of conveyors moving the respective opposed runs of each of the conveyors at substantially the same linear speed with respect to each other and moving the runs of each of the pairs of conveyors at a predetermined speed with respect to a preceding pair of conveyors so as to convey the fabric carried therebetween along the oven. A blower D directs heated air through the conveyors and the fabric carried therebetween. Thus, control of drying and shrinking may be facilitated. Each of the pairs of conveyors is carried in a respective module E of the oven. Each pair of conveyors has a fabric receiving end on a lower belt. Preferably the drive C overdrives preceding conveyor pairs with respect to succeeding conveyor pairs.

The method contemplates driving each conveyor pair for transporting the fabric in a substantially tensionless state to a next succeeding conveyor in serial relation thereto.

Figure 1:
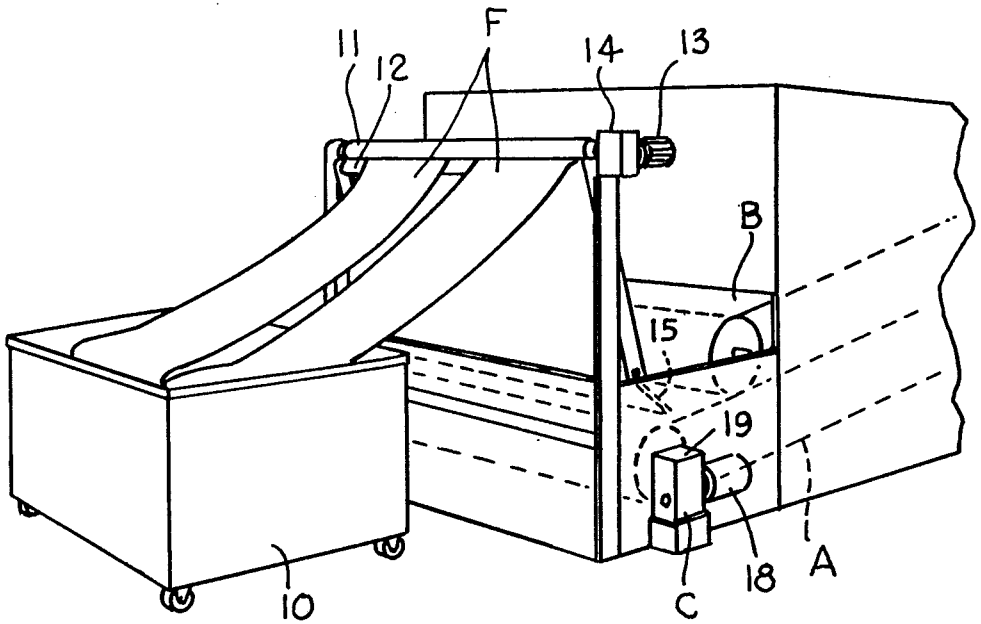
FIG. 1 is a perspective view schematically illustrating the entry end of a fabric dryer having modular conveyors constructed in accordance with the invention.
Figure 2:
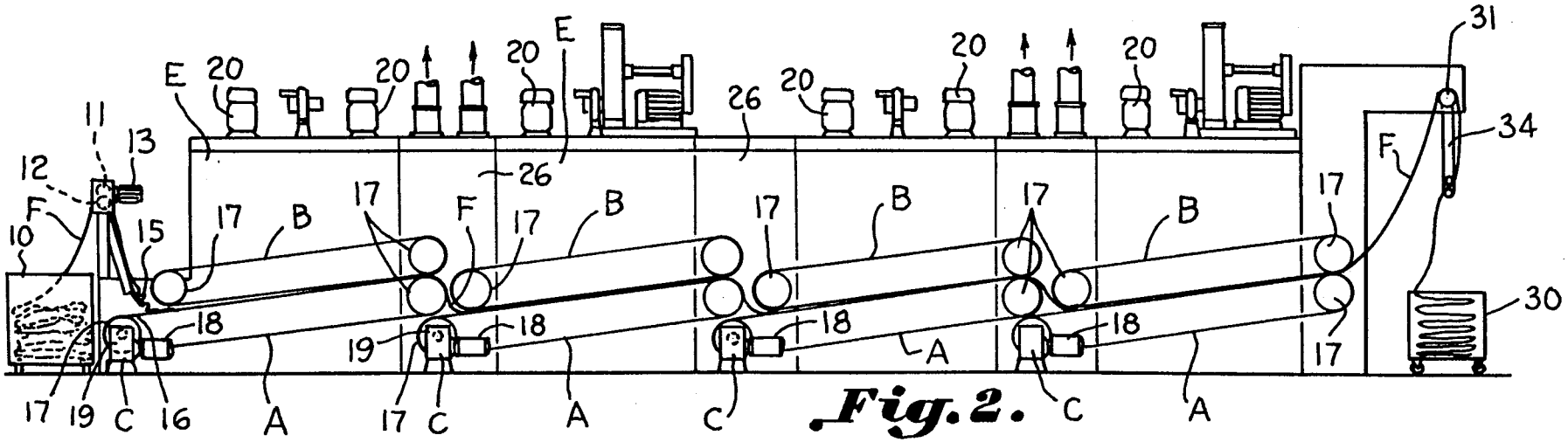
FIG. 2 is a schematic sectional side elevation, with parts omitted, further illustrating the modular conveyors.
Figure 3:
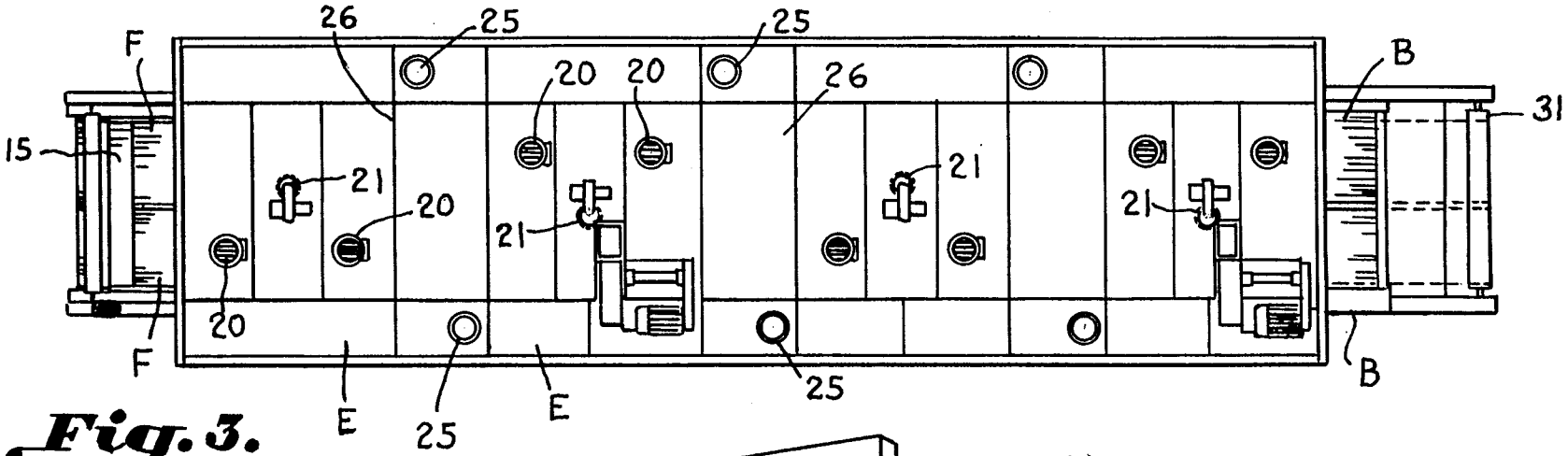
FIG. 3 is a schematic plan view, with parts omitted for clarity, further illustrating the fabric dryer.

FIG. 1 which illustrates the entry end of the dryer shows the fabric F being fed from the cart 10 between the nip of rolls 11 and 12 which are driven by a motor 13 through a suitable transmission 14 such as a gear box. A driven oscillating plate 15, which may also be driven by the motor 13, distributes the cloth upon a receiving end 16 of a first conveyor pair on the entry end of the lower belt A.

Each end of each foraminous belt of each conveyor pair has a rotatable drum 17 thereon for driving each belt A and B of respective conveyors at the same speed. The drum 17 adjacent the receiving end 16 of each lower belt A is driven by a drive C in the form of a speed control mechanism which may include a D.C. or other suitable motor 18 with transmission which may include a gear box 19 in order to drive each conveyor, including respective pairs of belts, at progressively slower speeds. Thus, each conveyor is overdriven with respect to succeeding conveyors. While a progressively slower speed is preferred or most often used in order to create a uniform tensionless state in the fabric, other predetermined speeds may be utilized in order to accommodate this or other purposes.

Figure 5:
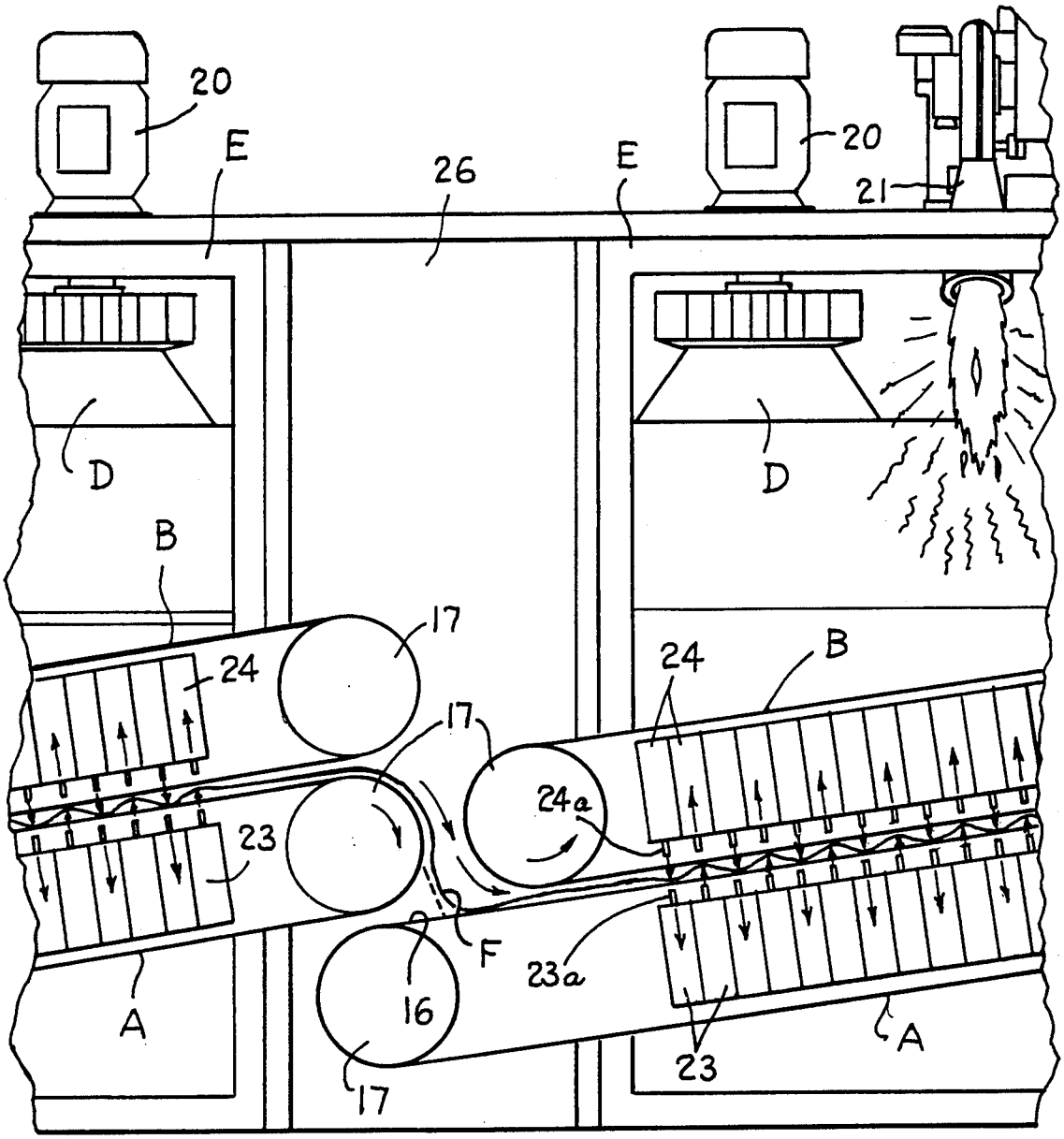
FIG. 5 is a perspective view illustrating the exit end of the fabric dryer.

A pair of blowers D (FIG. 5) are illustrated in each module E of the oven or range. Each of the blowers is driven by a motor 20 for directing air or other fluid heated as by burners illustrated at 21 for passage through opposed dispensers 23 and 24 positioned respectively on opposite sides of the fabric F. The air is exhausted as at 25 from each module of the dryer. A pair of blower motors are illustrated in FIG. 1 together with a gas burner 21 for each module or section E of the oven. Each module E has an intermediate structure 26 joining succeeding modules. Each of the pairs of conveyor belts A and B constitute a conveyor module and a pair of belts are illustrated in each oven module E. As the fabric is passed between opposed dispensers 23 and 24 air flowing through the respective nozzles 23*a* and 24*a* cause the fabric to ripple as illustrated in FIG. 5 to promote effective drying. It will be noted that the fabric F may be in a substantially tensionless state because of the free fall of gravity or at least controlled tension at the transfer or receiving end 16 of respective conveyor.

Any other suitable heating means, in addition to the gas burners illustrated at 21 may be utilized.

Figure 4:
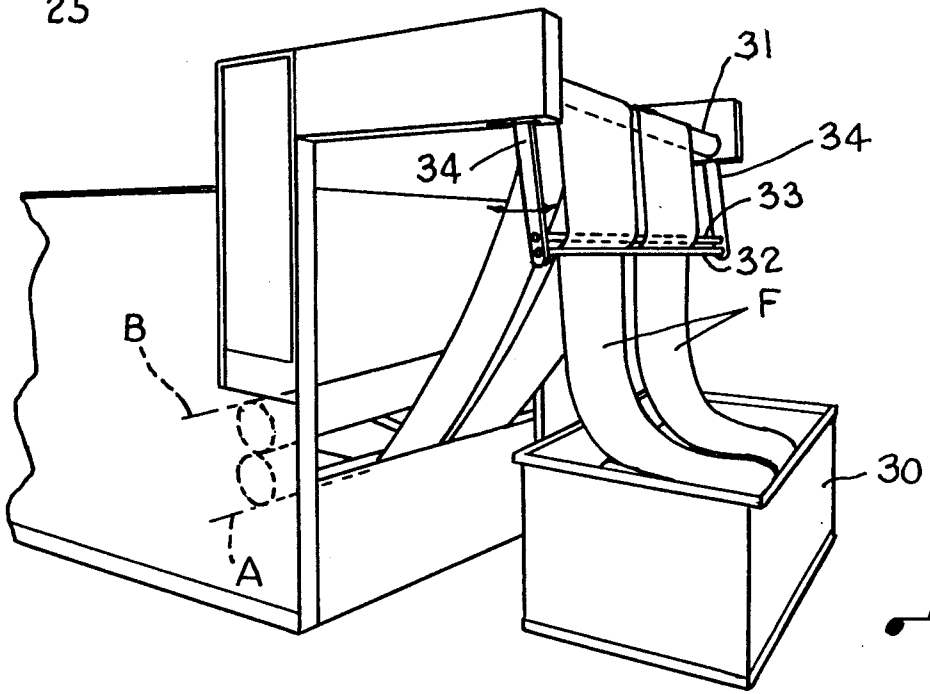
FIG. 4 is an enlarged sectional elevation, with parts omitted, illustrating fabric being fed from a conveyor to a next succeeding conveyor.

FIG. 4 illustrates an exit end of the range and the parallel lengths of fabric F are delivered into a cart 30. The fabric passes between the belts A and B of the last conveyor and over the roll 31 and downwardly between the delivery bars 32 and 33 of an oscillating frame including the driven pivoted arm 34 which are driven for oscillation.

It is thus seen that a range has been provided wherein shrinkage may be more accurately controlled by utilizing incremental conveyors. The incremental or modular conveyors preferably have a cascading arrangement wherein the fabric flows on successive upward paths with intermediate free falls to succeeding conveyor modules. The conveyors are provided with successive drive means so that each respective conveyor may be driven at a varied and predetermined speed. The serially arranged conveyors form serially arranged shrinkage zones throughout the oven.

While a preferred embodiment of the invention has been described using specific terms, such description is for illustrative purposes only, and it is to be understood that changes and variations may be made without departing from the spirit of the following claims.

What is claimed is:

1. A textile fabric drying and shrinking apparatus having an elongated oven containing means for blowing heated air through fabric conveyed through said oven comprising:

a plurality of upwardly inclined conveyors constructed of foraminous belts carrying said textile fabric thereon;

a drive for each of said conveyors moving said conveyors at a predetermined speed with respect to a preceding conveyor so as to convey said fabric along said oven; and a blower directing heated air through said conveyors and the fabric carried thereon;

whereby control of drying and shrinking may be facilitated.

2. The structure set forth in claim 1 wherein each of said conveyors is carried in a module in said oven.

3. The structure set forth in claim 1 including a belt having a run opposite said fabric carried on said conveyors limiting the movement of said fabric in respect to said foraminous belts.

4. The structure set forth in claim 3 wherein each of said conveyors is upwardly inclined.

5. The structure set forth in claim 4 wherein said drives move each of said conveyors at progressively slower speeds.

6. A dryer for an open length of fabric having an oven comprising:

a modular conveyor serially arranged in said oven to receive said fabric from a next preceding conveyor;

a drive for said conveyors overdriving said modular conveyor in respect to said next preceding conveyor;

a fabric delivery for transporting said fabric from said next preceding conveyor to said modular conveyor; and a blower directing heated air through said fabric on said conveyors;

whereby said open length of fabric is dried by said heated air under reduced tension.

7. A fabric dryer having an oven comprising:

a plurality of shrinkage zones serially arranged longitudinally in said oven;

each of said zones having a conveyor carrying an open length of cloth driven at a predetermined speed;

each of said conveyors being overdriven with respect to a next succeeding conveyor;

a cloth delivery in each of said shrinkage zones providing for a free fall of said open length of cloth to a next succeeding conveyor; and a dispenser for distributing heated air upon said fabric on said conveyors.

8. A fabric dryer having an oven comprising:

a first upwardly inclined foraminous conveyor for transporting an open length of fabric;

a second upwardly inclined foraminous conveyor having a receiving end below a delivery end of said first conveyor for receiving said open length of fabric from said first conveyor in a substantially tensionless state;

a conveyor drive overdriving said first conveyor in respect to said second conveyor; and a blower directing heated air upon said length of fabric on said conveyors;

whereby said length of fabric shrinks on said conveyors in a substantially tensionless state.

9. The method of frying and shrinking textile fabric in an elongated oven comprising the steps of:

moving said fabric upwardly in said oven between opposed runs of a pair of upwardly inclined conveyors constructed of foraminous belts carrying said textile fabric therebetween;

driving said conveyors moving said opposed run of said conveyors at a linear speed permitting said fabric to move downwardly to a next succeeding pair of upwardly inclined conveyors between opposed runs thereof; and blowing heated air through the fabric carried between said opposed runs;

whereby tension in said fabric may be incrementally controlled.

10. The method set forth in claim 9 including the step of moving the runs of each of said pairs of conveyors at progressively lower speeds with respect to a preceding pair of conveyors so as to convey said fabric carried therebetween along said oven.

11. The method of heat treating a shrinkable web in open width in an elongated oven comprising the steps of:

transporting said web to a conveyor;

driving said conveyor for transporting said web in a substantially tensionless state to a next succeeding conveyor in serial relation thereto;

positioning and driving said next succeeding conveyor for receiving and transporting said web in a substantially tensionless state from said first mentioned conveyor; and blowing a heated fluid into contact with said web during said transporting;

whereby said web shrinks in a substantially tensionless state as a result of contact by said heated fluid in a substantially tensionless state.

12. The method set forth in claim 11 wherein said web is a textile fabric, and including allowing the web to fall in a substantially tensionless state from said first mentioned conveyor to said succeeding conveyor.

13. The method of heat treating a shrinkable web in open width in an elongated oven comprising the steps of:

transporting said web on a driven conveyor on an upwardly inclined path;

then feeding said web downwardly to a next succeeding driven conveyor;

transporting said web on said next succeeding conveyor; and contacting said web with a heated fluid during said transporting;

whereby tension on said web may be controlled more accurately during heat treatment.

14. The method set forth in claim 13 wherein said web is textile fabric and including feeding said web by allowing it to fall upon said next succeeding driven conveyor.

15. The method set forth in claim 14 including moving said next succeeding conveyor in an upwardly inclined path.

16. The method set forth in claim 15 including overdriving said first mentioned conveyor in respect to said next succeeding conveyor.

17. The method set forth in claim 16 including blowing heated air through said fabric.

18. The method set forth in claim 17 including blowing said heated air upwardly through said fabric, and limiting movement of said fabric upwardly away from said conveyor as a result of said blowing.

* * * * *